United States Patent [19]

Rockwell

[11] 4,334,170

[45] Jun. 8, 1982

[54] MEANS AND METHOD FOR PROVIDING OPTIMUM RESOLUTION OF T.V. CATHODE RAY TUBE ELECTRON GUNS

[75] Inventor: Robert G. Rockwell, Arlington Heights, Ill.

[73] Assignee: Zenith Radio Corporation, Glenview, Ill.

[21] Appl. No.: 79,926

[22] Filed: Sep. 28, 1979

[51] Int. Cl.[3] ..... H01J 29/46; H01J 29/56

[52] U.S. Cl. ..... 315/16; 315/31 R; 313/449

[58] Field of Search ..... 315/16, 14, 31 R, 382; 313/449

[56] References Cited

U.S. PATENT DOCUMENTS

| | | | |
|---|---|---|---|
| 3,417,199 | 12/1968 | Yoshida et al. | 315/31 R |
| 3,995,194 | 11/1976 | Blacker, Jr. et al. | 315/16 |
| 4,009,410 | 2/1977 | Pommier et al. | 315/411 |
| 4,095,138 | 6/1978 | Schwartz | 315/16 |
| 4,168,452 | 9/1979 | Christensen et al. | 315/16 |

OTHER PUBLICATIONS

I. M. Wilson, Theoretical and Practical Aspects of Electron-Gun Design for Color Picture Tubes, IEEE Transactions on Consumer Electronics, vol. CE-21, No. 1, Feb. 1975, pp. 32-38.

*Primary Examiner*—Theodore M. Blum
*Attorney, Agent, or Firm*—Ralph E. Clarke, Jr.

[57] ABSTRACT

A novel electron gun for use in television cathode ray tubes of the direct view or projection type is disclosed. The cathode ray tube has associated therewith a power supply for developing a predetermined pattern of operating voltages including first and second adjustable voltages. The electron gun has apertured electrodes aligned on an axis for receiving the operating voltages to produce a focused beam of electrons. The electron gun comprises lower end means for generating an electron beam having a crossover. The beam expands in the aperture of a prefocusing electrode following the crossover and the outer rays of the expanding beam define a half-angle with respect to the axis. The tube also comprises main focus lens means adjacent to the prefocusing electrode for receiving the expanding beam and focusing the beam to form a beam spot of minimum size at a predetermined distance from the gun. The main focus lens means has at least a focusing electrode for receiving the first adjustable voltage for focusing the beam spot. The main focus lens means, by its inherent characteristics, is capable of focusing a minimum beam spot whose size is a function of the beam half-angle. The gun according to the invention is characterized by having at least one-half angle control element located in the region between the lower end means and the focus lens means and relatively widely spaced from the prefocusing electrode. The aperture of said control element is relatively larger than the aperture of the prefocusing electrode. Means are provided for receiving a second adjustable voltage from the power supply and applying the voltage to the control element for increasing or decreasing the strength of its half-angle control field and hence increasing or decreasing the half-angle. Means are provided for fixing the second adjustable voltage for maintaining a selected constant optimum voltage on the control element effective to cause the size of the focused beam spot to remain essentially minimum for equal focus voltage at different current levels.

6 Claims, 10 Drawing Figures

MEANS AND METHOD FOR PROVIDING OPTIMUM RESOLUTION OF T.V. CATHODE RAY TUBE ELECTRON GUNS

BACKGROUND OF THE INVENTION AND PRIOR ART DISCLOSURE STATEMENT

This invention relates generally to improvements in electron guns used in television receiver cathode ray tubes, and is more particularly addressed to improved means and method for adjusting certain operating parameters of electron guns to provide optimum beam spot size. The invention has applicability to television picture tube guns of many types and construction such as the unipotential, bipotential, the Einzel; guns having extended field main focus lenses, and guns designed for projection television. Such guns may be structured as a single gun, a triad of discrete guns, or the electrodes comprising the gun may be unitized and in delta or in-line configurations.

The type of electron gun in most common use for color cathode ray tubes is the unitized, in-line gun. Three electron beams are developed by cathodic thermionic emission. The beams are formed and shaped by a tandem succession of electrodes spaced along the central axis of the gun. These electrodes cause the beams to be selectively focused on groups of phosphors located on the faceplate of the cathode ray tube. The phosphors may comprise discrete triads consisting of red, green and blue dots, or more commonly, triads of red, green and blue stripes.

A prime objective in the design and manufacture of this and other types of electron guns is the projection of one or more small, symmetrical beam spots on the screen to provide maximum resolution of the television picture.

The structure and relationship of an electron gun and an associated picture tube, and the prior art means for supplying operating voltages to the combination, is indicated by FIG. 1. The primary components of a typical color picture tube 10 comprise an evacuated envelope including a neck 12, a funnel 14 and a faceplate 16. On the inner surface of the faceplate 16 are deposited a multiplicity of cathodoluminescent phosphor targets 18 comprising a pattern of groups of red-light-emitting, green-light-emitting, and blue-light-emitting dots or stripes. A perforated electrode 20 commonly called a "shadow mask" is located in close adjacency to faceplate 16 and phosphor targets 18, and is an element used for color selection. Base 22 provides entrance means for a plurality of electrically conductive lead-in pins 24.

The electron gun 26, indicated schematically, is located within neck 12 substantially as shown. Gun 26 is commonly installed in axial alignment with a center line X—X of picture tube 10. In three-beam color picture tubes utilizing the shadow mask, gun 26 emits three electron beams 28 to selectively activate target elements 18.

Power supply 30, also shown schematically, provides voltages for operation of the cathode ray tube 10 and its associated electron gun 26. A special voltage divider circuit is typically incorporated into the power supply to provide a range of potentials required for operation. For example, power supply 30 may supply relatively low voltages in the 1–8 kilovolt range through one or more conductors represented schematically by lead 32, which enters the envelope of tube 10 through one of a plurality of lead-in pins 24 in base 22. Power supply 30 also supplies selected intermediate voltages to the focus electrodes of electron gun 26, voltages typically in the range of 8–15 kilovolts or higher; these voltages are indicated as being supplied to the electrodes within the envelope of tube 12 by way of lead-in pins 24 through conductor 33. The relatively high voltage for electron gun operation, that is, a voltage typically in the range of 25 to 35 kilovolts for excitation of the accelerating anode, is indirectly supplied to gun 26 through lead 34, which is connected to anode button 36. Anode button 36 in turn introduces the high voltage through the glass envelope of funnel 14, making internal contact with a thin, electrically conductive coating 38 disposed on the inner surface of funnel 14, and extending part-way into neck 12. The anode electrode of gun 26 receives the relatively high anode voltage through a plurality of metallic gun centering springs 40 extending from gun 26, and in physical contact with inner conductive coating 38.

An electron beam diverging from the cross-over of electron gun defines a "half-angle" with respect to the axis of the gun. The half-angle is essentially a measure of beam growth in diameter as the beam diverges from the cross-over. A half-angle and means for its measure are shown schematically by FIG. 2. A cathode 35 is shown as emitting a stream of electrons which is formed into a beam 37. A cross-over 39 is formed from which beam 37 diverges. The slope of expansion of beam 37 defines an angle $\alpha$ with respect to the axis X—X of the electron gun. Angle $\alpha$ is measured from a selected "cut line" 41, which is, essentially, a point where the equipotential lines are perpendicular to the axis X—X. The half-angle is given good approximation by the expression $$\alpha=(0.22I^{\frac{1}{3}}/V_b) \text{ radians,}$$

for a neutral accelerating prefocus, where I is beam current in microamperes, and $V_b$ is beam voltage in kilovolts.

It is known that electron guns of particular types; e.g., bipotential, unipotential, guns having extended field lenses etc., have an optimum half-angle providing optimum spot size for the type. Further, each individual gun may have its own particular optimum half-angle that provides best performance in terms of the smallest possible spot size within the inherent capability of the particular gun.

The three principal contributors to the size of the focused beam spot on the screen are magnified cross-over, spherical aberration and space charge repulsion in the field-free space between the gun and screen of the picture tube. FIG. 3 shows graphically the dependence of spot size versus $\alpha$ for a gun with fixed P, Q, $V_a$, $I_{max}$ and W, where P is the distance from the image to the lens center, Q is the distance from the lens center to the beam spot, $I_{max}$ is four milliamperes (representing beam current), and $V_a$ is the ultor anode potential. "W" is a factor that defines the quality of the lower end of an electron gun according to the formula $$w = \frac{1}{d_x\alpha\sqrt{V_x}},$$

where $V_x$ is the voltage of the first electrode of the main focus lens ("G3"), and $d_x$ is the diameter of the cross-over.

FIG. 3 also shows each of the three separate contributors to spot size. The optimum spot size is indicated as being on the nadir of resultant curve 47. FIG. 3 shows that for fixed parameters there is only one half-angle from the crossover that gives the minimum spot size on the screen. FIG. 4 shows optimization curves for different W's. It can be seen, in general, that for a practical range of W (10–60), the optimum half angle stays approximately the same. In other words, the most important parameter in the design is the magnitude of the emerging half-angle $\alpha$, typically measured in milliradians.

A complete treatment of these and other key aspects in gun design is presented in a journal article titled "Theoretical and Practical Aspects of Electron Gun Design for Color Picture Tubes", by I. M. Wilson. (IEEE Transactions on Consumer Electronics, Volume CE-21, No. 1, February 1975.)

The establishment of the most effective half-angles in electron guns has been based almost entirely on the electromechanical design parameters of the lower end sections. The factors that affect formation of the cross-over and subsequent prefocusing of the beam prior to its entry into the main focus lens and the resultant half-angle, include the configuration of the first and second grids, spacing between the cathode and first grid, and between the first and second grids and the following element of the main focus lens, aperture sizes, and the configurations of the grids as designed to establish the prefocusing fields. Once these factors are established, being of mechanical structure they are relatively fixed and unchangeable by any influences external to the envelope of the cathode ray tube. So heretofore it has not been feasible by means of external adjustments to achieve the optimum half-angle for any particular electron gun.

U.S. Pat. No. 4,009,410 to Pommier et al discloses an electron gun comprising at least one supplementary electrode of the "diaphragm" type arranged between the accelerator grid and the anode of the gun, and placed at a positive potential lower than that of the anode. The supplementary electrode, or diaphragm, is said to constitute, in association with the anode aperture, a second electrostatic condenser lens to produce a second cross-over in the electron beam. The anode voltage is varied to achieve the proper efficiency for each of the three beams producing three colors. The benefits are alleged to be better image definition, a constant cathode current and constant modulation, and brilliance modulation as a linear function of the cathode current.

Schwartz in U.S. Pat. No. 4,095,138 discloses an electron gun characterized by having at least one arc-inhibiting electrode disposed between the grid means of the tetrode and the initial end electrode of an extended field main focus lens. the arc-inhibiting electrode has a potential thereon that is intermediate to the disparate potentials of the grid means and the initial end electrode to provide an arc-inhibiting voltage gradient between the grid means and the initial end electrode between which may exist widely disparate potentials with a potential difference in the range of tens of kilovolts.

OBJECTS OF THE INVENTION

It is a general object of the invention to provide for improved performance of electron guns used in color television cathode ray tubes.

It is a less general object to provide for improved performance of electron guns for color television cathode ray tubes, including types such as the bipotential, unipotential, and guns having extended field lenses.

It is a more specific object of the invention to provide for minimizing the size of beam spots projected by color television cathode ray tube guns within the maximum performance capability of such guns.

It is a specific object of the invention to provide means and method for external adjustment of the operating parameters of such guns to provide the smallest possible beam spot commensurate with the focusing capability of the individual electron gun.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings, in the several figures of which like reference numerals identify like elements, and in which:

DESCRIPTION OF THE PREFERRED EMBODIMENTS

Figure 1:
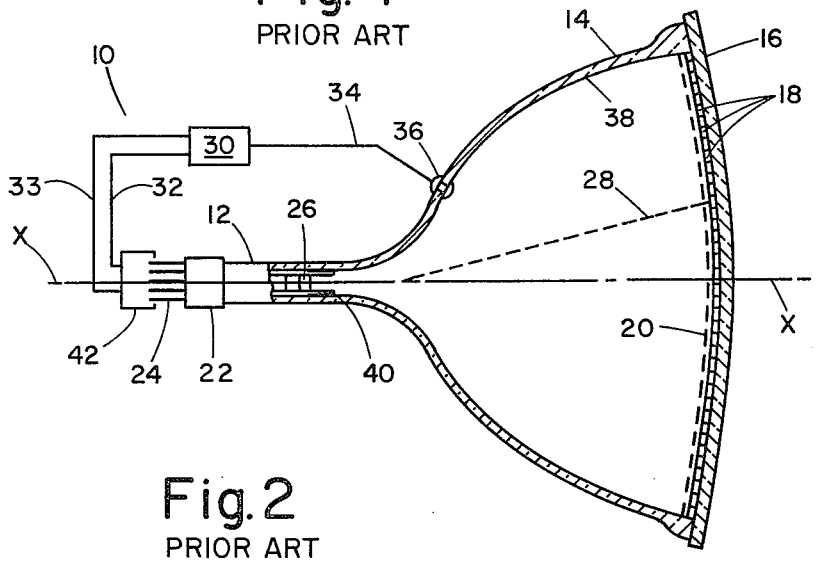
Fig. 1 PRIOR ART
FIG. 1 is a schematic side sectional view of a prior art color cathode ray picture tube and its interconnections with an associated power supply.
Figure 2:
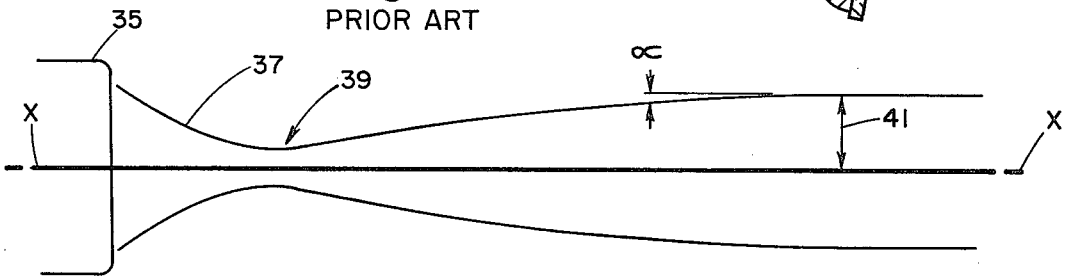
Fig. 2 PRIOR ART
FIG. 2 is a diagram in profile of an electron beam indicating a half-angle defined with respect to the axis of the beam.
Figure 3:
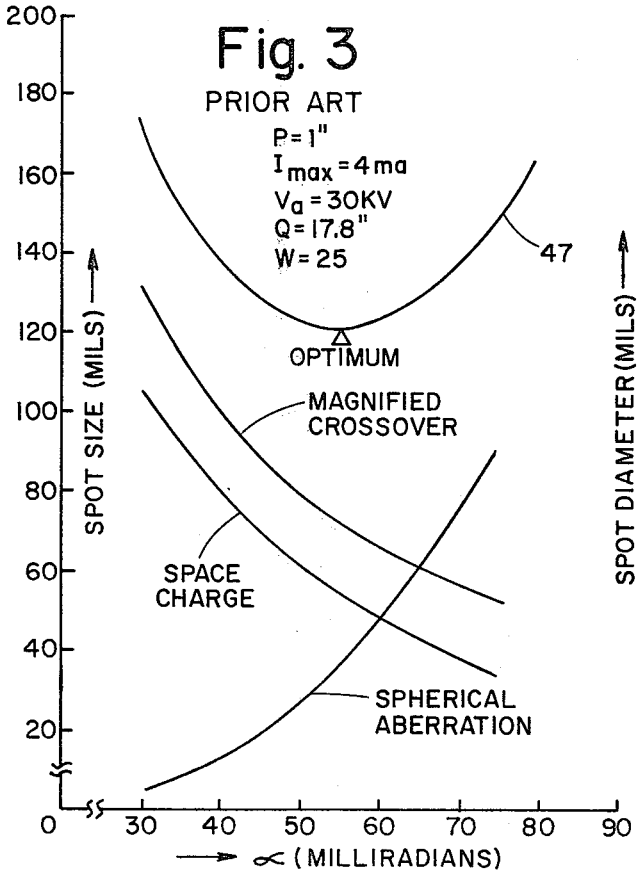
Fig. 3 PRIOR ART
FIGS. 3 and 4 are drawings defining factors that contribute to the spot size of electron beams and their effect.
Figure 4:
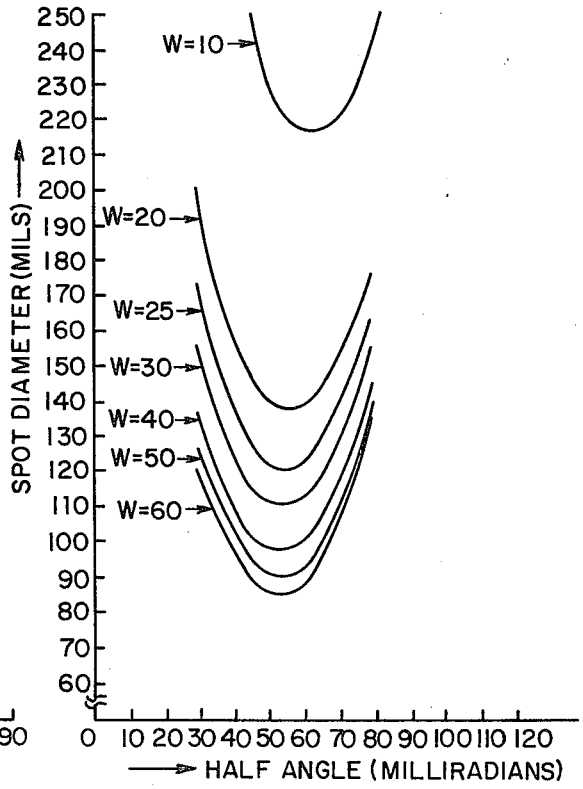
Fig. 4 PRIOR ART
Figure 5:
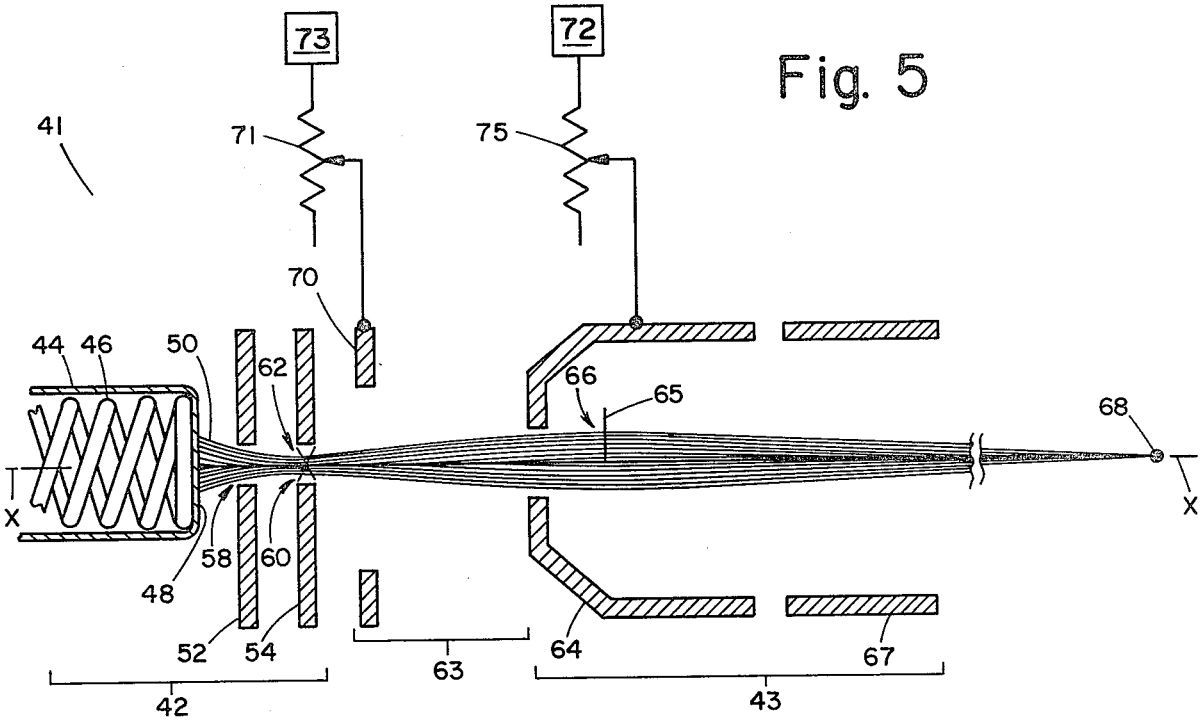
FIG. 5 is a schematic view in section of an electron gun having a novel control electrode according to the invention, and showing the effect of the electrode on a beam passing therethrough.

FIG. 5 is a schematic view of an electron gun incorporating the present invention. Electron gun 41 is shown as being of the bipotential type; that is, a gun distinguished by having a two-element main focus lens with each element having a different potential thereon. The means and method according to the invention is in no way restricted to an electron gun of the type shown by FIG. 5 but are equally applicable and valuable in other types, as will be shown.

Electron gun 41 is divided for exposition into two separate parts: a "lower end" means 42 and a main focus lens means 43. Lower end means 42 provides for generating an electron beam having a crossover. The beam expands in a prefocusing section following the crossover and the outer rays of the expanding beam define a half-angle with respect to the axis of the gun, as has been shown. Lower end means 42 is shown as being made up of three parts constituting a "triode" (disregarding part number 70, the function of which will be described infra). Other types of electron guns may have four parts comprising the lower end; such lower ends are termed "tetrode". Lower end means 42 includes a cathode 44 which has a resistive filament 46 enclosed therein. When energized electrically, resistive filament 46 heats cathode 44 to cause the emission of free electrons from an electron-emitting surface 48 to generate beam 50. Following cathode 44 in a succession of components are first grid 52 and second grid 54.

The potential on cathode 44 is typically varied from 0 volts to 150 volts positive by the external television video drive circuitry. The potential on first grid 52 is typically maintained at a constant 0 volts. The quantity of electrons, hence the beam current drawn from cathode 44, is a function of the relative potential of cathode 44 and first grid 52. As cathode 44 is driven more positive by the video drive circuitry, first grid 52 becomes more negative relative to cathode 44, with the result that fewer electrons are drawn from cathode 44 to pass through aperture 58 of first grid 52. It is by this means that the intensity of beam 50 is controlled by the bias on cathode 44 in relation to first grid 52. As cathode 44 is caused to become less positive, more electrons are emitted by cathode 44 to pass through aperture 58 of first grid 52.

The free electron emission rate of cathode 44, the spacing between cathode 44 and first grid 52, and the diameter of aperture 58 all combine to determine the point at which the beam crossover 60 is formed. The crossover is defined as the point at which a stream of principal electrons leaving the cathode 44 form a circle of least confusion on the gun axis X—X following the convergence zone in aperture 58 of first grid 52. The location of the crossover 60 is normally approximately within aperture 62 of second grid 54. The crossover point is not firmly fixed, but moves a finite distance toward and away from cathode 44 as a result of the changing of the potential on cathode 44.

After passing through aperture 58 of first grid 52, the electrons comprising beam 50 are drawn toward second grid 54, which may have, for example, a potential of one kilovolt thereon. The difference in potential between first grid 52, described as being zero, and the potential of second grid 54 creates an electrostatic field that promotes strong velocity of beam 50 to provide the smallest possible crossover under ideal conditions.

After passing through the point of crossover 60, beam 50 expands in the prefocusing field formed in the interspace 63 between second grid 54 and the first electrode 64 of main focus lens 43. It should be noted that the axial length of this interspace is greatly exaggerated for illustrative purposes; the spacing between grids 52 and 54 and electrode 64 is typically about 40 mils.

The electrons comprising beam 50 diverge following the crossover to form an expanding beam. The expansion is due to the effect of the prefocusing field formed in interspace 63; also, the increased space charge contributions due to the low energy of beam 50 also contribute to beam expansion.

Beam 50 is represented as entering main focus lens means 43 which receives the expanding beam and focuses the beam to focus a beam spot of minimum size at a predetermined distance from gun 41. Main focus lens 43 is shown as having a focusing electrode 64 and an accelerating electrode 67. The potentials on the electrodes 64 and 67 may be, respectively, 6 kilovolts and 30 kilovolts. Main focusing lens 43 is shown highly schematically as focusing beam 50 to a point 68 of focus on the viewing screen of the cathode ray tube faceplate (not shown).

Electron gun 41 is characterized by having a half-angle control element 70 according to the invention located in the region between lower end means 42 and main focus lens means 43. A power supply associated with the television cathode ray tube developes a predetermined pattern of operating voltages including at least a first adjustable voltage 72 and a second adjustable voltage 73. Control element 70 receives second adjustable voltage 73 to generate a half-angle control field of adjustable strength. Focusing electrode 64 receives first adjustable voltage 72 for focusing beam spot 68. Main focus lens means 43, by its inherent characteristics, is capable of focusing a minimum beam spot whose size is a function of the beam half angle. The half-angle of gun 41 is indicated as being measured from a cut line 65 located within element 64 of main focus lens 43. The point of measurement of half-angle 66 is indicated by the arrow. Cut line 65 is defined as the point on the axis X—X where there is a shift in the "sense" of the field; e.g., the point at which the field shifts from negative to positive; i.e., a point where the field is equal to zero according to the formula $$(dV/dZ=0,$$

where V is voltage in kilovolts and Z is the location on axis X—X.

Figure 6:
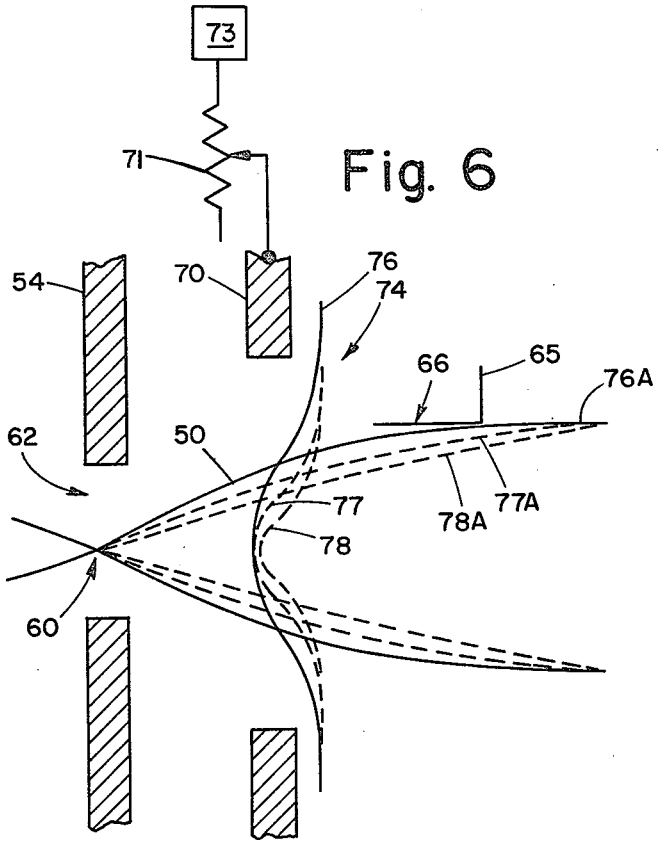
FIG. 6 is a sectional view in elevation of electrodes and electrode fields showing schematically the beneficial effect of the novel control electrode according to the invention.

The novel effect of a half-angle control element according to the invention is indicated schematically by figure 6. Half-angle control element 70 is shown as receiving second adjustable voltage 73 which is part of a power supply (not indicated). The voltage on half-angle control element 70 causes element 70 to generate the half-angle control field 74 of adjustable strength; the field 74 as adjusted is indicated by the equipotential lines 76, 77 and 78. Means 71 for adjusting second adjustable voltage 73 (indicated highly schematically) are provided such that upon adjustment of voltage adjustment means 71 to increase the strength of the half-angle control field 74, the half-angle 66 is increased. Conversely, upon adjustment of the voltage adjustment means 71 to decrease the strength of field 74, half-angle 66 is decreased. By this means according to the invention, an optimum half-angle providing a minimum beam spot size is attainable.

The effect of the field 74 of adjustable strength on half-angle 66 will be seen with reference to equipotential line 76 representing the field of decreased strength, resulting in the outer rays of beam 50 defining a contour indicated by ray 76A, causing the half-angle 66 to decrease. A progressive increase in the strength of field 74 resulting in a progressive increase in half-angle 66 is indicated by the contour of ray 77A and the effect of the greater strength of field 74 indicated by equipotential line 77. Similarly, the contour of ray 78A, and the consequent greater half-angle, is the effect of a field of increased strength indicated by equipotential line 78. As the voltage on half-angle control element 70 is adjusted to become more positive, the half-angle 66 increases; conversely, as the voltage is adjusted to become less positive, the half-angle 66 decreases Typically, a voltage adjustment of +500 volts will produce a change in half-angle of about 0.005 milliradians, when using a half-angle control element having a relatively large aperture, as indicated.

Figure 7:
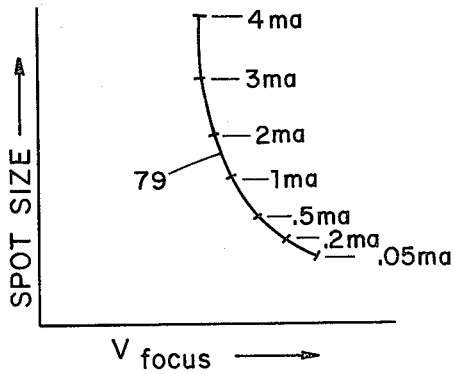
FIG. 7 is a drawing of a focus track that indicates the change in spot size at various beam currents resulting from the application of the means and method according to the invention.

Another benefit is that the means and method according to the invention provide for "straightening" the best focus track. A typical "best" focus track is shown by FIG. 7; curve 79 indicates spot size at different current levels as plotted against focus voltage. It is important that the spot size of the focused beam be minimum for equal focus voltage at different current levels. The ideal would be the case where the best focus track curve 79 is essentially vertical. The means and method according to the invention contribute substantially toward attaining this ideal.

The method according to the invention is for use in the manufacture of a television receiving system of the direct view or projection type; the method enables the system to provide a minimum beam spot size. The method comprises providing a half-angle control element in the region between the lower end means and the main focus lens means to establish a half-angle control field in that region. An adjustable voltage designated the "second adjustable voltage," is applied to the half-angle control element to vary the strength of the half-angle control field. A first adjustable voltage; that is, a voltage applied to the focusing electrode, is adjusted to focus the smallest possible beam spot at a predetermined distance for the electron gun. The second adjustable voltage is adjusted such that when the voltage is increased, the increase in field strength of the half-angle control element causes the half-angle to increase. Conversely, when the voltage is decreased, the decrease in field strength causes the half-angle to decrease. A setting of the second adjustable voltage is selected while monitoring the beam spot size to produce an optimum beam half-angle and thus a minimum spot size for a given setting of the first adjustable voltage.

Figure 8:
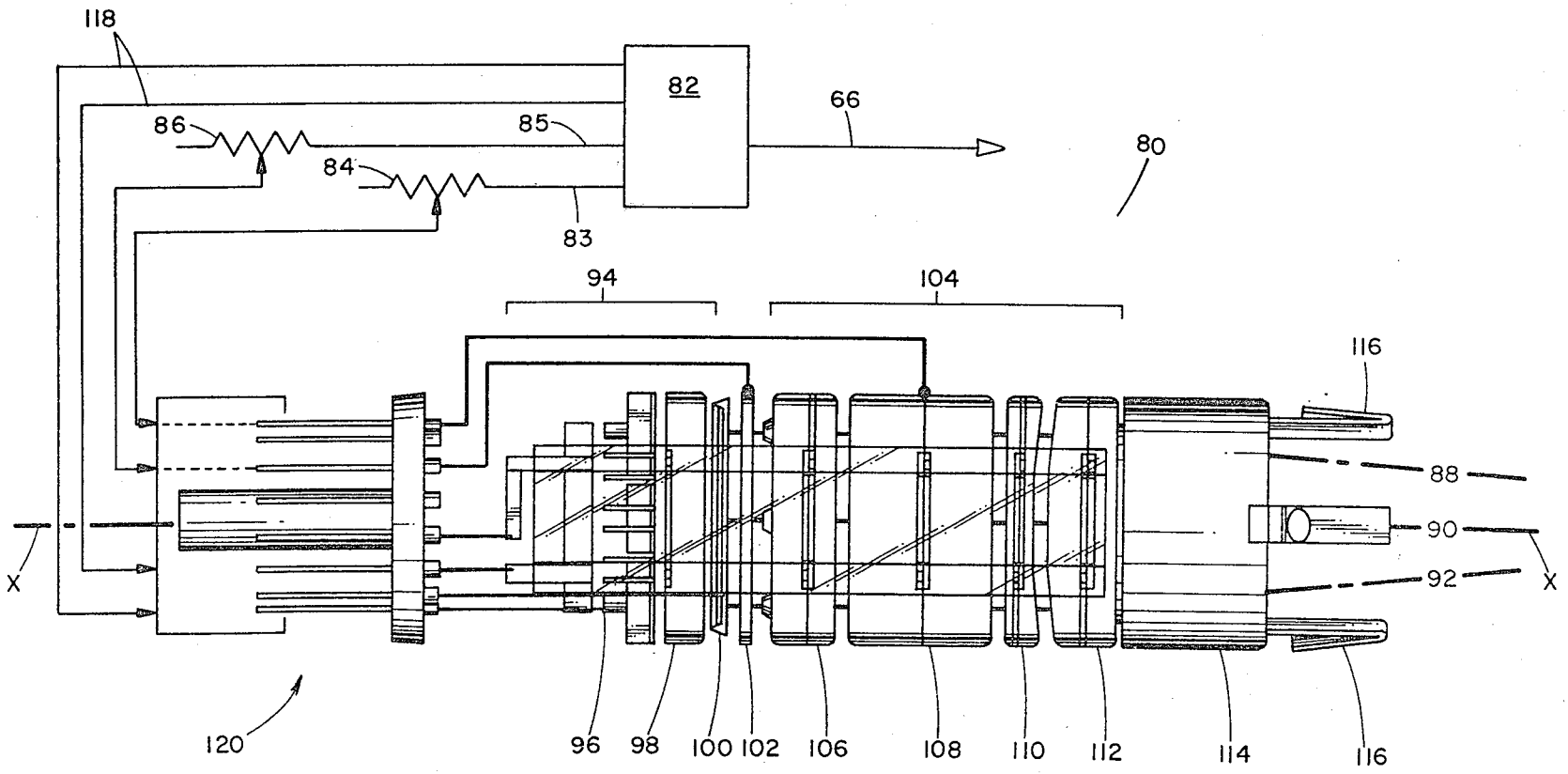
FIG. 8 is a top view of an assembled electron gun having an extended field lens and a novel control electrode according to the invention.

The present invention finds useful application in electron guns having the extended field electrostatic focus lens described and fully claimed in U.S. Pat. No. 3,995,194 to Blacker et al., assigned to the assignee of the present invention. FIG. 8 is an assembled view of a three-beam, unitized, in-line electron gun having an extended field lens according to the '194 Patent, and incorporating the present invention. The electron gun 80 is suitable for use in television cathode ray tubes. The cathode ray tube has associated therewith a power supply 82 for developing a predetermined pattern of operating voltages including a first adjustable voltage and a second adjustable voltage, which are shown as being routed to respective electrodes 108 and 102 of gun 80 by conductors 83 and 85. The voltage adjustment means for the respective voltages are indicated highly schematically by 84 and 86.

Electron gun 80 is shown as being a three-beam, unitized, in-line electron gun having axially aligned electrodes for receiving the operating voltages to produce three focused beams of electrons 88, 90, and 92 for exciting red, green, and blue target elements, respectively, located on the faceplate of the cathode ray tube (not shown).

Electron gun 80 comprises lower end means 94 for generating the three electron beams 88, 90 and 92, each of which has a crossover as has been described. Each beam expands in a prefocusing section following the crossover, with the outer rays of each expanding beam defining a half-angle with respect to the associated axis. The lower end 94, indicated by the brackets, includes three discrete unitized cathode means 96 and unitized first grid means 98 and second grid means 100.

At least one half-angle control element 102, depicted in FIG. 8 as comprising one element, is located in the region between the lower end means 94 and the main focus lens means 104; the purpose and function of half-angle control element 102 will be described infra.

Main focus lens means 104, indicated by the bracket, receives the expanding beams and focuses the beams to form three converged beam spots of minimum size on the faceplate of the cathode ray tube. As noted, the three beams are designated as 88, 90 and 92. Main focus lens means 104 comprises at least three main focus electrodes (the number is shown as being four in the FIG. 8 example). Main focus lens means 104 includes a focusing electrode 106 for receiving the first adjustable voltage 86 for focusing the beam spots. Also, main focus lens means 104 receives a predetermined pattern of voltages from power supply 82 to establish a single continuous electrostatic focusing field characterized by having an axial potential distribution which, in the direction of electron beam flow, at all times during tube operation decreases smoothly and monotonically from a relatively intermediate potential to a relatively low potential; i.e., a potential which is many kilovolts lower than the relatively intermediate potential spatially located at a lens intermediate position. The axial potential distribution then increases smoothly, directly and monotonically from the relatively low potential to a relatively high potential; i.e. a potential which is many kilovolts higher than the relatively intermediate potential. Main focus lens means 104 by its inherent characteristics is capable of focusing minimum beam spots whose sizes are functions of the half-angles of the respective beams. Main focus lens means 104 is shown as being made up of electrode 106, focusing electrode 108, and electrodes 110 and 112. A shield cup 114, with snubber springs 116 dependent therefrom, is shown as being attached to electrode 112.

The output of power supply 82, which provides the predetermined pattern of operating voltages including first and second adjustable voltages 84 and 86, is shown as being routed to the electrodes of gun 80 through a series of electrical conductors 118 with the potentials so conducted entering base-socket assembly 120, and thence to the various electrodes by the internal conductors depicted in FIG. 8.

Gun 80 is characterized by having at least one half-angle control element, shown in this example as being a single control element 102, located in the region between lower end means 94 and main focus lens means 104. Control element 102 receives the second adjustable voltage conducted by conductor 85 from the power supply 82 to generate a half-angle control field of adjustable strength according to the invention, with the effect on the half-angle as heretofore described.

Figure 9:
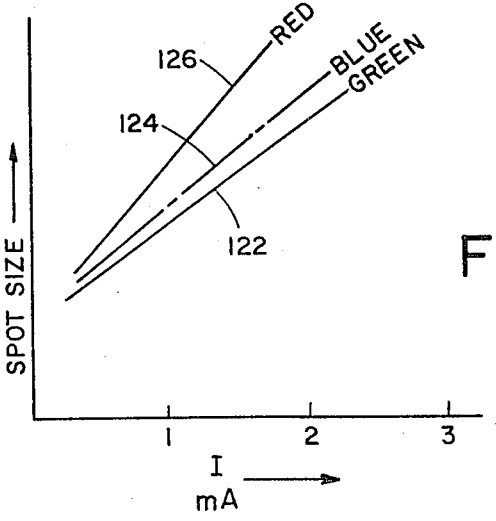
FIG. 9 is a drawing indicating the measure of relative spot sizes of the three beams of a unitized electron gun having in common a novel control electrode according to the invention; and, FIG. 10 is a schematic view in section of a bipotential electron gun having a novel control electrode according to the invention.

It will be recognized that attaining optimum half-angles for each of the electron guns in a three-beam electron gun such as shown by FIG. 8, which has unitized electrodes (electrodes of common structure for different gun parts), is complicated by the fact that the half-angle control element, being unitized, can provide an optimum half-angle adjustment for only one of the guns, unless it should happen that all three of the unitized guns require the same optimum half angle. The potential on the half-angle control element 102 could be adjusted to provide the best "average" half-angle for all three guns; however, it is preferable to adjust the potential of only one of the guns for optimum half-angle. The choice is that gun which projects the beam that excites the green phosphors deposited on the faceplate. The rationale for the choice of green for optimum half-angle is that the most information is contained in the green image, and that the red and blue elements are relatively subordinate in terms of information perceived by the viewer. The relative effect is shown by FIG. 9, which is a "fixed-focus track" representation; that is, the focus voltage is fixed, e.g., to that required at a beam current of one milliampere. Line 122 represents the fixed focus track of the electron gun that illuminates the green phosphor targets as adjusted for optimum half-angle. Lines 124 and 126 represent the fixed focus tracks of the beams exciting the blue and red phosphors, respectively. The effect on the spot size of the electron guns exciting the red and blue phosphors will be seen to be relatively inconsequential.

Figure 10:
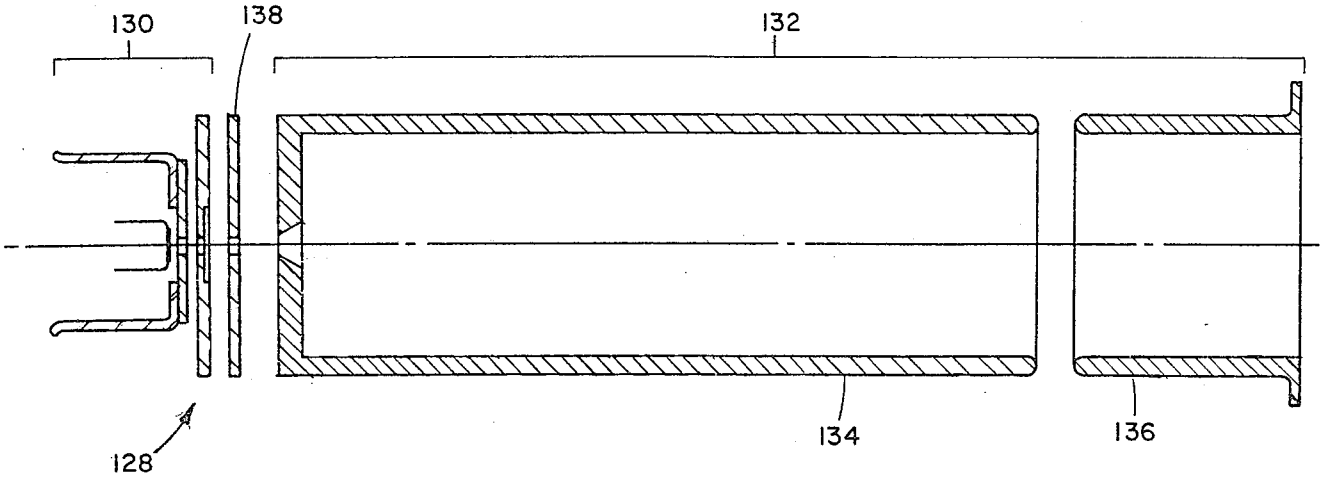

The means and method according to the invention have been found to be particularly effective in electron guns of the type used for projection television. An electron gun designed for projection television is shown schematically by FIG. 10. Electron gun 128 is shown as having lower end means 130 for generating an electron beam having a crossover. Lower end means 130 is shown as comprising a cathode and a first and second grid means. A main focus lens means 132 receives the expanding beam and focuses the beam to focus a beam spot of minimum size at a predetermined distance from gun 128. Main focus lens means 132 is indicated as being a bipotential lens; that is, a lens comprising an electrode 134 for focusing the expanding beam, and an anode electrode 136 providing mainly for accelerating the beam. Projection electron gun 128 is characterized by having a half-angle control element 138 located in the region between lower end means 130 and main focus lens means 132.

It is notable that the provisions of the half-angle control element according to the invention in projection electron gun 128 provides for a reduction in beam spot size of the order of one-half. For example, the beam spot size of projection guns has been reduced from 30 mils to 15 mils at a beam current of 1.5 milliamperes with a corresponding marked increase in resolution.

Other benefits are provided by the invention in addition to that of providing a minimum beam spot size for a particular electron gun. For example, again with reference to electron guns of the projection type, by adjustment of the voltage on the half-angle control element according to the invention, the configuration of projected beam spot at the full deflected position can be adjusted for a more satisfactory contour by adjustment of the applied voltage. This adjustment can be made with minimum change in spot size or contour at the center of the screen.

As has been described, the half-angle control electrode according to the invention comprises at least one electrode element located between the lower end of the electron gun and the main focus lens. The element may comprise an aperture electrode, for example; that is, a relatively flat plate having a thickness in the range of 8 to 20 mils, and having an aperture therein. A suitable material for such an electrode is an austenitic grade of stainless steel designated as AISI type 305. The electrode element could as well be in the form of the well-known cylinder electrode with the depth being limited as necessary by spatial considerations.

The profile of the control element would preferably match the profiles of adjacent electrodes of the electron gun. Spacing in relation to the adjacent electrodes would be in the range, preferably, of 25 to 50 mils.

The diameter of the aperture is shown as being larger than the diameter of the aperture in the associated second grid of the lower end. For example, the aperture size of the second grid may be about 60 mils, while the aperture size of the control element may be about 115 mils, conforming to the dimensions of the beam passing therethrough, which as noted, is expanding prior to its entry into the main focus lens. It is to be noted that the smaller the aperture in the half-angle control element, the greater will be the effect on the half-angle. A half-angle control element according to the invention can be mounted similarly to all other electrodes of the electron gun in that it may have one or more "claws" projecting from opposite sides for the embedment in the glass beads commonly used to structurally support the electrodes of the gun.

A half-angle control element must be electrically discrete as it receives a separate adjustable voltage. The suggested range of this voltage is an adjustment from +500 to −1,000, relative to the voltage on second grid 54, with the exact voltage dependent upon the type and individual characteristics of the electron gun. A simple modification of television receiver power supply circuit would be required to supply such a voltage. The means of adjustment can be, for example, a screwdriver-adjusted potentiometer with a locknut to fix the proper voltage level once it is arrived at. It is to be noted that there is relatively little "drift" in the half-angle once the proper voltage is determined. The half-angle adjustment has proved to be very stable over the operating life of the electron gun.

Attaining the preferred half-angle for a particular gun is a matter of simple visual observation. The proper adjustment of the potential on the half-angle control element according to the invention is that adjustment which provides the best picture tube resolution—best resolution being a corollary of the smallest spot size.

While particular embodiments of the invention have been shown and described, it will be obvious to those skilled in the art that changes and modifications may be made without departing from the invention in its broader aspects, and therefore, the aim of the appended claims is to cover all such changes and modifications as fall within the true spirit and scope of the invention.

I claim:

1. For use in a television cathode ray tube of the direct view or projection type having associated therewith a power supply for developing a predetermined pattern of operating voltages including at least first and second adjustable voltages, an electron gun having apertured electrodes aligned on an axis for receiving said operating voltages to produce a focused beam of electrons comprising:

lower end means for generating an electron beam having a crossover, said beam expanding in the aperture of a prefocusing electrode, the outer rays of said expanding beam defining a half-angle with respect to said axis;

main focus lens means adjacent to prefocusing electrode for receiving said expanding beam and focusing said beam to form a beam spot of minimum size at a predetermined distance from said gun, said main focus lens means having at least a focusing electrode for receiving said first adjustable voltage for focusing said beam spot, said main focus lens means, by its inherent characteristics, being capable of focusing a minimum beam spot whose size is a function of the beam half angle;

said gun being characterized by having:

at least one half-angle control element located in the region between said prefocusing electrode and said main focus lens means and relatively widely spaced from said prefocusing electrode, the aperture of said control element being relatively larger than the aperture of said prefocusing electrode;

means for receiving a second adjustable voltage from said power supply in the range of a few hundred volts plus or minus relative to the voltage on said prefocusing electrode;

means for applying said second adjustable voltage to said half-angle control element of selectively adjusting the strength of the field induced by said control element, such that when said means for adjusting said voltage on said control element is adjusted to increase the strength of the half-angle control field, said half-angle is increased; and conversely, when said voltage is adjusted to decrease the strength of the half-angle control field, said half-angle is decreased; and means for fixing said second adjustable voltage for maintaining a selected constant optimum voltage on said control element, effective to cause the size of the focused beam spot to remain essentially minimum for equal focus voltage at different current levels.

2. For use in a television cathode ray tube of the direct view or projection type having associated therewith a power supply for developing a predetermined pattern of operating voltages including first and second adjustable voltages, a bipotential electron gun having apertured electrodes aligned on an axis for receiving said operating voltages to produce a focused beam of electrons comprising:

lower end means for generating an electron beam having a crossover, said beam expanding in the aperture of a prefocusing electrode following said cross over, the outer rays of said expanding beam defining a half-angle with respect to said axis;

main focus lens means adjacent to said prefocusing electrode for receiving said expanding beam and focusing said beam to form a beam spot of minimum size at a predetermined distance from said gun, said main focus lens means having at least a focusing electrode for receiving said first adjustable voltage for focusing said beam spot, said main focus lens means, by its inherent characteristics, being capable of focusing a minimum bean spot whose size is a function of the beam half angle;

said gun being characterized by having:

at least one half-angle control element located in the region between said prefocusing electrode and said main focus lens means and relatively widely spaced from said prefocusing electrode, the aperture of said control element being relatively larger than the aperture of said prefocusing electrode;

means for receiving a second adjustable voltage from said power supply. in the range of a few hundred volts plus or minus relative to the voltage on said prefocusing electrode;

means for applying said second adjustable voltage to said half-angle control element for selectively adjusting the strength of the field induced by said control element, such that when said means for adjusting said voltage on said control element is adjusted to increase the strength of the half-angle control field, said half-angle is increased; and conversely, when said voltage is adjusted to decrease the strength of the half-angle control field, said half-angle is decreased; and means for fixing said second adjustable voltage for maintaining a selected constant optimum voltage on said control element, effective to cause the size of the focused beam spot to remain essentially minimum for equal focus voltage at different current levels.

3. For use in a television cathode ray tube having associated therewith a power supply for developing a predetermined pattern of operating voltages including first and second adjustable voltages, a three-beam, unitized, in-line electron gun having axially aligned apertured electrodes for receiving said operating voltages to produce three focused beams of electrons for exciting red, green and blue target elements respectively on the faceplate of said tube, said gun comprising:

lower end means for generating three electron beams, each with a crossover, each beam expanding in the aperture of an associated prefocusing electrode, the outer rays of each of said expanding beams defining a half-angle with respect to the associated axis;

main focus lens means adjacent to said prefocusing electrode for receiving said expanding beams and focusing said beams to form three converged beam spots of minimum size at a predetermined distance from said gun on said faceplate, said main focus lens means comprising at least three main focus lens electrodes including a focusing electrode for receiving said first adjustable voltage for focusing beam spots, said main focus lens means receiving a predetermined pattern of voltages from said power supply to establish a single, continuous electrostatic focusing field characterized by having an axial potential distribution which, in the direction of electron beam flow, at all times during tube operation, decreases smoothly and monotonically from a relatively intermediate potential to a relatively low potential; i.e., a potential which is many kilovolts lower than the relatively intermediate potential, spatially located at a lens intermediate position, and then increases smoothly, directly and monotonically from the relatively low potential to a relatively high potential; i.e., a potential which is many kilovolts higher than the relatively intermediate potential, said main focus lens means by its inherent characteristics being capable of focusing minimum beam spots whose sizes are a function of the half-angles of the respective beams;

said gun being characterized by having:

at least one half-angle control element located in the region between said prefocusing electrode and said main focus lens means and relatively widely spaced from said prefocusing electrode, the apertures of said control element being relatively larger than the apertures of said prefocusing electrode;

means for receiving a second adjustable voltage from said power supply in the range of a few hundred volts plus or minus relative to the voltage on said prefocusing electrode;

means for applying said second adjustable voltage to said half-angle control element for selectively adjusting the strength of the field induced by said control element, such that when said means for adjusting said voltage on said control element is adjusted to increase the strength of the half-angle control field, said half-angles of said expanding beams are increased; and conversely, when said voltage is adjusted to decrease the strength of the half-angle control fields, said half-angles are decreased; and means for fixing said second adjustable voltage for maintaining a selected constant optimum voltage on said control element, effective to cause the size of the focused beam spots to remain essentially minimum for equal focus voltage at different current levels, whereby at least one optimum half-angle providing a minimum beam spot size is attainable.

4. For use in the manufacture of a television receiving system of the direct view of projection type, said system having a cathode ray picture tube with an electron gun having lower end means including a prefocusing electrode for generating an expanding electron beam, the outer rays of said beam defining a half-angle with respect to the axis of said gun, said gun further including a main focus lens means adjacent to said prefocusing electrode including at least a focusing electrode for focusing said beam at a predetermined distance from said gun in response to a first adjustable voltage, said main focus lens means, by its inherent characteristics, being capable of focusing a minimum beam spot whose size is a function of the beam half-angle, a method for enabling said system to provide a minimum beam spot size comprising:

providing at least one half-angle control element, and locating said control element in the region between said prefocusing electrode and said main focus lens means;

providing said element with an aperture relatively larger than the aperture of said prefocusing electrode;

spacing said control element relatively widely from said prefocusing electrode;

applying a second adjustable voltage to said control element and providing a range of said voltage a few hundred volts plus or minus relative to the voltage on said prefocusing electrode;

selectively adjusting the strength of the field induced by said control element by adjusting said second adjustable voltage such that when said voltage is increased to increase the strength of said field, said half-angle is increased; and conversely, when said voltage is decreased to decrease the strength of said field, said half-angle is decreased; and maintaining a selected constant optimum voltage on said control element effective to cause the size of the focused beam spot to remain essentially minimum of equal focus voltage at different current levels.

5. For use in the manufacture of a television receiving system of the direct veiw or projection type, said system having a cathode ray picture tube with a bipotential electron gun having lower end means including a prefocusing electrode for generating an expanding electron beam, the outer rays of said beam defining a half-angle with respect to the axis of said gun, said gun further including a main focus lens means adjacent to said prefocusing electrode including at least a focusing electrode for focusing said beam at a predetermined distance from said gun in response to a first adjustable voltage, said main focus lens means, by its inherent characteristics, being capable of focusing a minimum beam spot whose size is a function of the beam half-angle, a method for enabling said system to provide a minimum beam spot size comprising:

providing at least one half-angle control element, and locating said control element in the region between said prefocusing electrode and said main focus lens means;

providing said element with an aperture relatively larger than the aperture of said prefocusing electrode;

spacing said control element relatively widely from said prefocusing electrode;

applying a second adjustable voltage to said control element and providing a range of said voltage a few hundred volts plus or minus relative to the voltage on said prefocusing electrode;

selectively adjusting the strength of the field induced by said control element by adjusting said second adjustable voltage such that when said voltage is increased to increase the strength of said field, said half-angle is increased; and conversely, when said voltage is decreased to decrease the strength of said field, said half-angle is decreased; and maintaining a selected constant optimum voltage on said control element effective to cause the size of the focused beam spot to remain essentially minimum for equal focus voltage at different current levels.

6. For use in the manufacture of a television receiving system of the direct view or projection type having a cathode ray picture tube with a three-beam electron gun having unitized apertured electrodes; that is, electrodes of common structure for different gun parts, said electron gun having axially aligned electrodes for receiving operating voltages from a power supply for exciting red, green and blue target elements, respectively, deposited on the faceplate of said tube, said electron gun having lower end means including a focusing electrode for generating three electron beams each with a cross-over, each beam expanding in an associated aperture of said prefocusing electrode, the outer rays of said beams defining half-angles with respect to the associated axes of said gun, said gun further including a main focus lens means adjacent to said prefocusing electrode for receiving said expanding beams, said lens including at least a focusing electrode for focusing said beams on the respective target elements in response to a first adjustable voltage, said main focus lens means, by its inherent characteristics, being capable of focusing three minimum beam spots whose size is a function of the half-angle of the respective beams, a method for enabling said system to provide a minimum beam spot size comprising:

providing at least one half-angle control element, and locating said control element in the region between said prefocusing electrode and said main focus lens means;

providing said element with apertures relatively larger than the apertures of said prefocusing electrode;

spacing said control element relatively widely from said prefocusing electrode;

applying a second adjustable voltage to said control element and providing a range of said voltage a few hundred volts plus or minus relative to the voltage on said prefocusing electrode;

selectively adjusting the strength of the field induced by said control element by adjusting said second adjustable voltage such that when said voltage is increased to increase the strength of said field, said half-angles of said expanding beams are increased; and conversely, when said voltage is decreased to decrease the strength of said field, said half-angles are decreased; and maintaining a selected constant optimum voltage on said control element effective to cause the size of the focused beam spots to remain essentially minimum for equal focus voltage at different current levels, whereby at least one optimum half-angle providing a minimum beam spot size is attainable.

* * * * *